US009305732B2

(12) United States Patent
Murowaki et al.

(10) Patent No.: US 9,305,732 B2
(45) Date of Patent: Apr. 5, 2016

(54) ELECTRONIC PART AND ELECTRONIC CONTROL UNIT

(71) Applicants: DENSO CORPORATION, Kariya, Aichi-pref. (JP); Murata Manufacturing Co., Ltd., Nagaokakyoj-shi, Kyoto-fu (JP)

(72) Inventors: Toru Murowaki, Chiryu (JP); Toru Itabashi, Anjo (JP); Yuki Mikami, Kariya (JP); Ryoichi Shiraishi, Okazaki (JP); Shigeki Nishiyama, Nagaokakyo (JP)

(73) Assignees: DENSO CORPORATION, Kariya (JP); Murata Manufacturing Co., Ltd., Nagaokakyo-shi (JP)

( * ) Notice: Subject to any disclaimer, the term of this patent is extended or adjusted under 35 U.S.C. 154(b) by 193 days.

(21) Appl. No.: 14/190,280

(22) Filed: Feb. 26, 2014

(65) Prior Publication Data

US 2014/0240081 A1 Aug. 28, 2014

(30) Foreign Application Priority Data

Feb. 28, 2013 (JP) ..... 2013-38362

(51) Int. Cl.
*H05K 1/16* (2006.01)
*H01H 85/20* (2006.01)

(52) U.S. Cl.
CPC ..... *H01H 85/201* (2013.01)

(58) Field of Classification Search
CPC ..... H01H 2085/0275; H01H 85/0241; H01H 85/10; H05K 1/0263; H05K 1/181; H05K 2201/10181; H05K 2201/10946; H05K 3/3426
USPC ..... 361/15, 103, 104, 275.4, 628, 630, 642, 361/646, 738, 766, 783; 337/33, 157, 158, 337/159, 168
See application file for complete search history.

(56) References Cited

U.S. PATENT DOCUMENTS 5,784,248 A * 7/1998 Tomiyasu ..... H01G 2/04 361/275.4
6,794,584 B2 * 9/2004 Tanaka ..... H01M 2/20 174/260

(Continued)

FOREIGN PATENT DOCUMENTS

JP 2005-116642 A 4/2005
JP 2006-24825 A 1/2006
JP 2007-311467 A 11/2007

OTHER PUBLICATIONS

U.S. Appl. No. 14/190,249, filed Feb. 26, 2014, Mikami et al.

(Continued)

*Primary Examiner* — Yuriy Semenenko
(74) *Attorney, Agent, or Firm* — Posz Law Group, PLC

(57) ABSTRACT

A main body of an electronic part is supported by terminals at a position above and separated from a board surface of a printed board. Each of the terminals is composed of a supporting member made of electrically insulating material and a wiring member. Each of the wiring member has an electrode-connected portion electrically connected to an electrode formed on the main body and a land-connected portion electrically connected to a land formed in the printed board. One of the wiring members is composed of a fuse wiring member having a cut-off portion, which is melted down when excess current flows. The wiring member is outwardly expanded in a direction opposite to the main body.

9 Claims, 5 Drawing Sheets

(56) References Cited

U.S. PATENT DOCUMENTS

| | | | | |
|---|---|---|---|---|
| 7,630,208 | B2 * | 12/2009 | Lee | H01G 4/012 361/301.3 |
| 2005/0111166 | A1 * | 5/2005 | Kita | B60R 16/0239 361/624 |
| 2012/0200970 | A1 | 8/2012 | Itabashi et al. | |
| 2013/0102205 | A1 * | 4/2013 | Onoda | H01H 69/04 439/874 |

OTHER PUBLICATIONS

U.S. Appl. No. 14/190,210, filed Feb. 26, 2014, Itabashi et al.
U.S. Appl. No. 14/190,250, filed Feb. 26, 2014, Shiraishi et al.
U.S. Appl. No. 14/190,297, filed Feb. 26, 2014, Kamiya et al.
U.S. Appl. No. 14/190,299, filed Feb. 26, 2014, Itabashi et al.

* cited by examiner

ELECTRONIC PART AND ELECTRONIC CONTROL UNIT

CROSS REFERENCE TO RELATED APPLICATION

This application is based on Japanese Patent Application No. 2013-038362 filed on Feb. 28, 2013, the disclosure of which is incorporated herein by reference.

FIELD OF TECHNOLOGY

The present disclosure relates to an electronic part mounted to a printed board and an electronic control unit having the electronic part.

BACKGROUND

A printed board having a pattern fuse, which is a part of wiring patterns formed in the printed board, is known in the art, for example, as disclosed in Japanese Patent Publication No. 2007-311467.

The pattern fuse is generally so formed as to be narrower than a remaining part of the wiring patterns. Therefore, for example, when a short-circuit occurs in an inside of an electronic device or an electronic part and thereby excess current flows, the pattern fuse is melted down due to heat generation in order that an electric pathway is cut off.

In a case of the pattern fuse, it is necessary to individually design the pattern fuses when the pattern fuses are used for different types of electronic parts or when the pattern fuses are used to the same type of the electronic part but ratings of the electronic parts are different from each other. As a result, it is difficult to commonalize or standardize the printed boards for different types of electronic control units. In other words, it is difficult to commonalize the printed boards and to simply change the electronic parts to be mounted to the printed board in order to use the same type of the printed board for the different types of the electronic control units (variation products).

In addition, it is difficult to make a size of the printed board as well as the electronic control unit smaller, because the pattern fuse (or pattern fuses) is provided on the printed board as a part of the wiring patterns.

In addition, since the pattern fuse is formed on a board surface of the printed board, it is a problem that melted-down portions of the pattern fuse may be connected again after the pattern fuse is melted down. In particular, re-connection of the melted-down portions is more likely to occur due to density growth of the printed board.

SUMMARY OF THE DISCLOSURE

The present disclosure is made in view of the above problems. It is an object of the present disclosure to provide an electronic part and an electronic control unit having the electronic part, according to which it is possible to commonalize and/or standardize a printed board, to which the electronic parts are mounted, and to make a size of the printed board smaller. In addition, re-connection of melted-down portion of a fuse portion is prevented.

According to a feature of the present disclosure, an electronic part mounted to a printed board has a main body arranged at a position above and separated from a board surface of the printed board and the main body has at least one electronic element and multiple electrodes for the electronic element. The electronic part has a terminal for supporting the main body at the position above and separated from the board surface of the printed board, wherein the terminal electrically connects one of the electrodes to a corresponding land formed in the printed board.

The terminal comprises;

a supporting member made of electrically insulating material and having one end in contact with the main body and another end in contact with the board surface of the printed board in order to support the main body at the position above and separated from the board surface; and a wiring member having an electrode-connected portion connected to one of the corresponding electrodes of the main body and a land-connected portion soldered to the land in a condition that the main body is supported at the position above and separated from the board surface.

The supporting member comprises;

a holding portion made of the electrically insulating material and being in contact with the main body for holding the main body; and a leg portion extending from the holding portion to the printed board, the leg portion being elastically deformable in a direction in which the multiple electrodes are arranged.

The wiring member comprises;

the electrode-connected portion electrically and mechanically connected to the corresponding electrode of the main body;

the land-connected portion connected to the leg portion and soldered to the land; and a connecting portion for electrically connecting the electrode-connected portion to the land-connected portion.

The wiring member is composed of a fuse wiring member, and the fuse wiring member has a cut-off portion, which is formed at least as a part of the connecting portion and which has a width smaller than that of other portions of the connecting portion, so that the cut-off portion is melted down depending heat generated by excess current in order to cut off the excess current.

According to the above feature, the terminal is provided in the electronic part, one of the wiring members is composed of the fuse wiring member having the cut-off portion. Therefore, it is possible to commonalize the printed boards, which can be used for different types of the electronic control units. In addition, it is possible to reduce a size of the printed board and the electronic control unit by such a volume corresponding to a fuse terminal, which can be eliminated in the present disclosure.

Furthermore, according to the above feature, the cut-off portion is formed as a part of the connecting portion of the fuse wiring member. As a result, the cut-off portion is supported at the position above and separated from the board surface of the printed board. It is, thereby, possible to prevent such a situation that the melted-down cut-off portion is connected again.

In particular, according to the present disclosure, a wiring function for connecting the electrodes to the lands and a supporting function for supporting the main body above the board surface are independently provided in the wiring member and the supporting member. As a result, even when the cut-off portion is melted down, it is possible to support the main body by the supporting member. It is, therefore, possible to effectively prevent re-connection of the fuse wiring member.

In addition, according to the above feature, the supporting member is elastically deformable in the direction, in which the electrodes are arranged. When a difference of expansion and contraction (a relative displacement) is generated between the printed board and the main body by a difference of linear coefficient of expansion, the supporting member is elastically deformed. As a result, it is possible to reduce stress applied to connected areas between the wiring members and the electrodes and stress applied to connected areas between the wiring members and the lands.

According to another feature of the present disclosure, the connecting portion is outwardly expanded in a direction opposite to the main body from a virtual line connecting the electrode-connected portion and the land-connected portion with each other.

According to the above feature, when the printed board is expanded with respect to the main body depending on increase of ambient temperature and the leg portion of the supporting member is elastically deformed, the connecting portion can be also elastically deformed in accordance with the deformation of the leg portion. Since the connecting portion has a flexible structure for absorbing the elastic deformation of the leg portion as above, it is possible to further increase reliability for the mechanical and electrical connection between the electrodes and the lands.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION OF THE EMBODIMENTS

Figure 1:
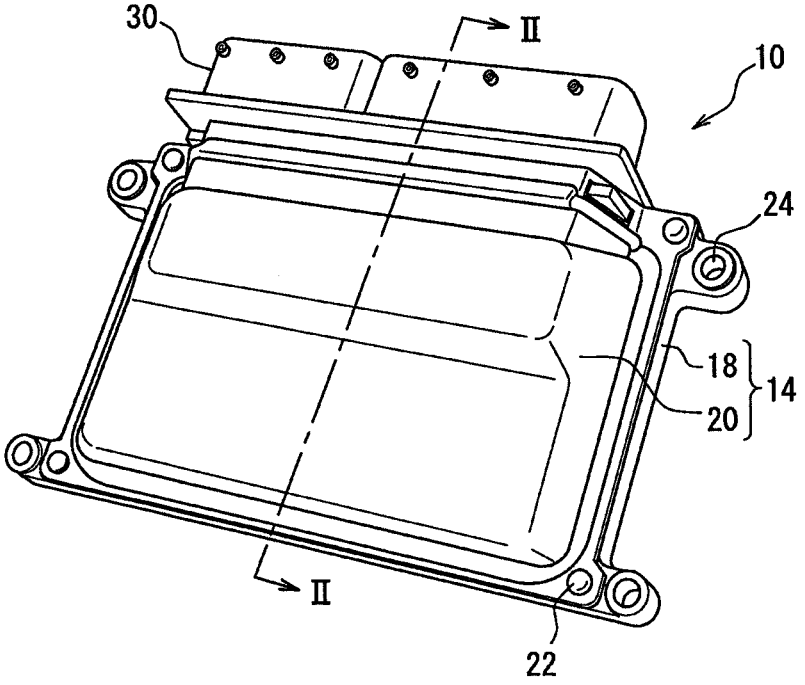
FIG. 1 is a perspective view schematically showing a structure of an electronic control unit according to a first embodiment of the present disclosure.

The present disclosure will be explained hereinafter byway of multiple embodiments. The same reference numerals are given to the same or similar portions and/or structures throughout the embodiments, for the purpose of eliminating repeated explanation.

First Embodiment

Figure 2:
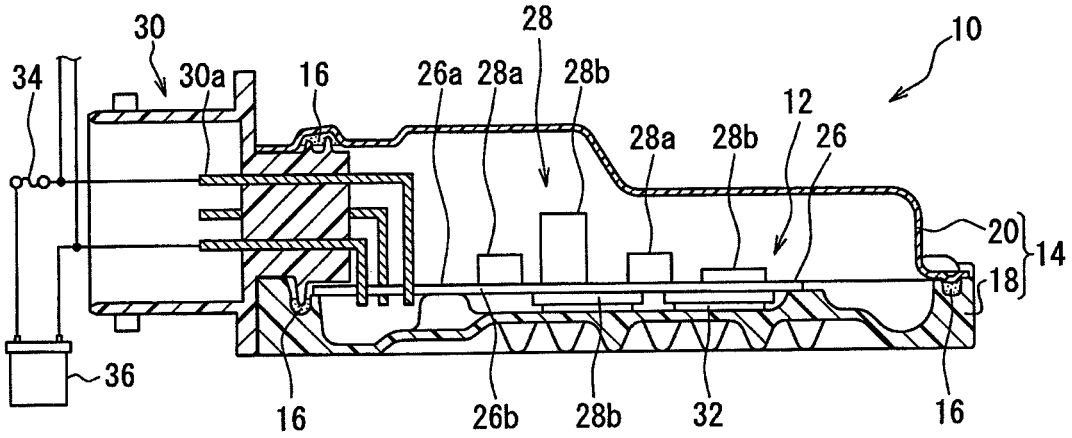
FIG. 2 is a schematic cross sectional view taken along a line II-II in FIG. 1.

An electronic control unit 10 shown in FIGS. 1 and 2 has a circuit board 12 as a main part thereof. The electronic control unit 10 further has a housing 14 for accommodating the circuit board 12 and a seal element 16. In the present embodiment, the electronic control unit 10 is formed as an electronic control unit (ECU) of a water-proof type for controlling an operation of an engine for a vehicle.

An outline structure for the electronic control unit 10 will be hereinafter explained.

The housing 14 is made of metal, such as, aluminum, iron or the like, or resin material, for accommodating therein the circuit board 12 so as to protect the same from water, dust and so on. A number of parts for forming the housing 14 is not limited to a specific number, so that the housing 14 may be composed of one or multiple members.

As shown in FIG. 2, according to the present embodiment, the housing 14 is composed of two parts, that is, a lower casing 18 of a shallow-box shape having an upper open end and an upper casing 20 for closing the upper open end of the lower casing 18. The upper casing 20 is fixed to the lower casing 18 by multiple screws 22 (or bolts) to form an inside space of the housing 14 for accommodating the circuit board 12. In an assembled condition of the housing 14, a portion (or multiple portions) of the circuit board 12 is directly or indirectly interposed between the lower and the upper casings 18 and 20, so that the circuit board 12 is firmly held at a predetermined position inside of the housing 14.

In the present embodiment, the housing 14 is divided into the lower and the upper casings 18 and 20 in a vertical direction (a thickness direction of the circuit board 12). However, a dividing direction for the parts (the lower casing 18 and the upper casing 20) of the housing 14 is not limited to the vertical direction.

Multiple through-holes 24 (four in the present embodiment) are formed at each corner of the lower casing 18 in order that screws or bolts (not shown) are respectively inserted into the through-holes 24 so as to fix the electronic control unit 10 to a predetermined position, for example, to an engine block. An aperture is formed in the housing 14 so that a portion of a connector 30 outwardly protrudes from the inside of the housing 14.

The seal element 16 has a function for preventing water from coming into the inside space of the housing 14. As shown in FIG. 2, the seal element 16 is arranged at a position, at which outer peripheries of the lower and the upper casings 18 and 20 are opposed to each other. The seal element 16 is also arranged at a position, at which the housing 14 and the connector 30 are opposed to each other.

The circuit board 12 is composed of a printed board 26, to which multiple electric or electronic parts and/or components 28 (hereinafter collectively referred to as the electronic parts 28), such as a micro-computer, power transistors, resistors, capacitors and the like are mounted to form electric circuits. The electronic parts 28 are mounted to at least one of board surfaces (a front-side board surface 26*a* and a back-side board surface 26*b*) of the printed board 26. In the present embodiment, as shown in FIG. 2, the electronic parts 28 are mounted to both of the board surfaces 26*a* and 26*b* of the printed board 26.

For example, multiple electronic parts 28*a* are mounted to the front-side board surface 26*a* of the printed board 26, wherein each of the electronic parts 28*a* has a fuse terminal 46*a* (FIGS. 3 and 4), as explained below. The electronic parts 28*a* correspond to those electronic parts requiring the pattern fuses in a conventional device. The electronic parts other than the electronic parts 28*a* (having the fuse terminal 46*a*) are designated by 28*b* (having no fuse terminal) in the drawing, for the sake of convenience.

In addition to the electronic parts 28, the connector 30 is further mounted to the printed board 26 for electrically connecting the electric circuits formed in the circuit board 12 to outside devices (not shown). In FIG. 2, multiple pins 30*a* of the connector 30 are mounted to the printed board 26 by a through-hole mounting process. However, the pins 30*a* may be alternatively mounted to the printed board 26 by a surface-mounting process or a surface-mounting structure.

A reference numeral 32 in FIG. 2 designates heat radiation gel arranged between some of the electronic parts 28*b* and the lower casing 18 and being in contact with them, so as to transfer heat of the electronic parts 28*b* to the lower casing 18.

In the above-explained electronic control unit 10, an outside connector (not shown) is fitted to the connector 30 (the pins 30*a* of the connector 30), so that the electronic control unit 10 is electrically connected to a wire harness (not shown). The connector 30 is electrically connected to a battery 36 (a direct current power source) via a main fuse 34 for protecting the electronic control unit 10 from excess current. The battery 36 is also connected to other electronic control units (not shown), such as a brake control ECU, a steering control ECU, a body ECU, a navigation device and so on.

Since the main fuse 34 is provided in a path for supplying electric power necessary for operating the various kinds of the electronic devices, including the electronic control unit 10, a large-size fuse (for example, a fuse element for 15 A, 20 A or the like) is used for the main fuse 34. The main fuse 34 is melted down by the excess current larger than a predetermined value, when any defect or trouble occurs in any one of the electronic devices (including the electronic control unit 10) and thereby the excess current flows through the main fuse 34. Then, the power supply via the main fuse 34 is cut off to prevent an adverse effect to the other electronic devices.

Figure 3:
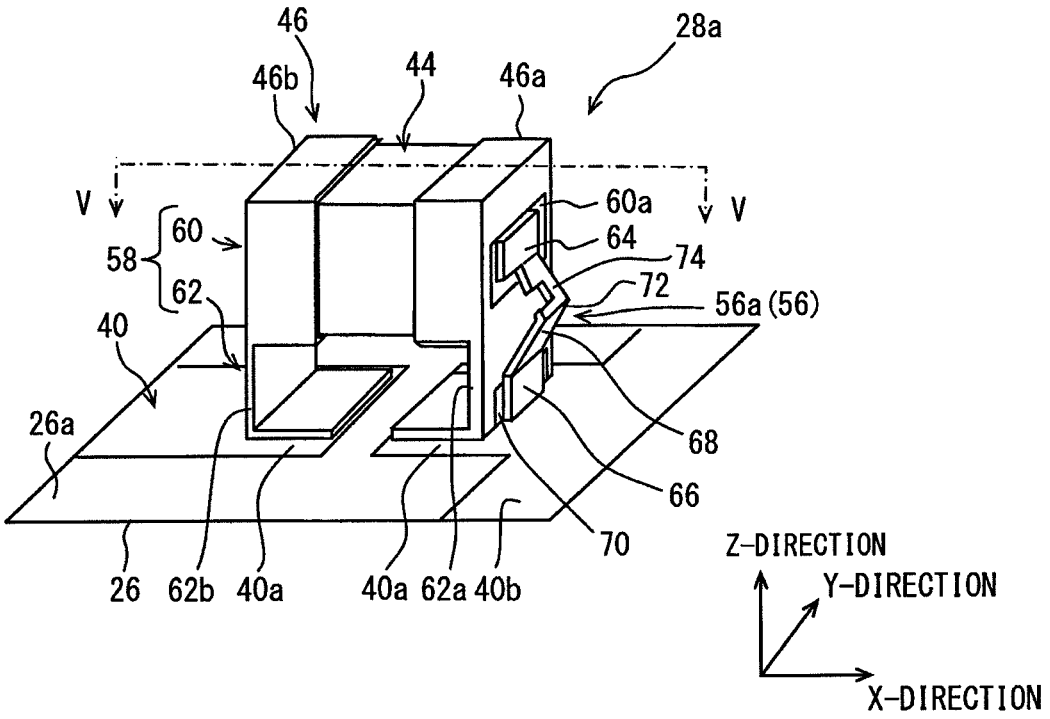
FIG. 3 is a schematically enlarged perspective view showing a portion of a printed board (an electronic part mounted to the printed board)
Figure 4:
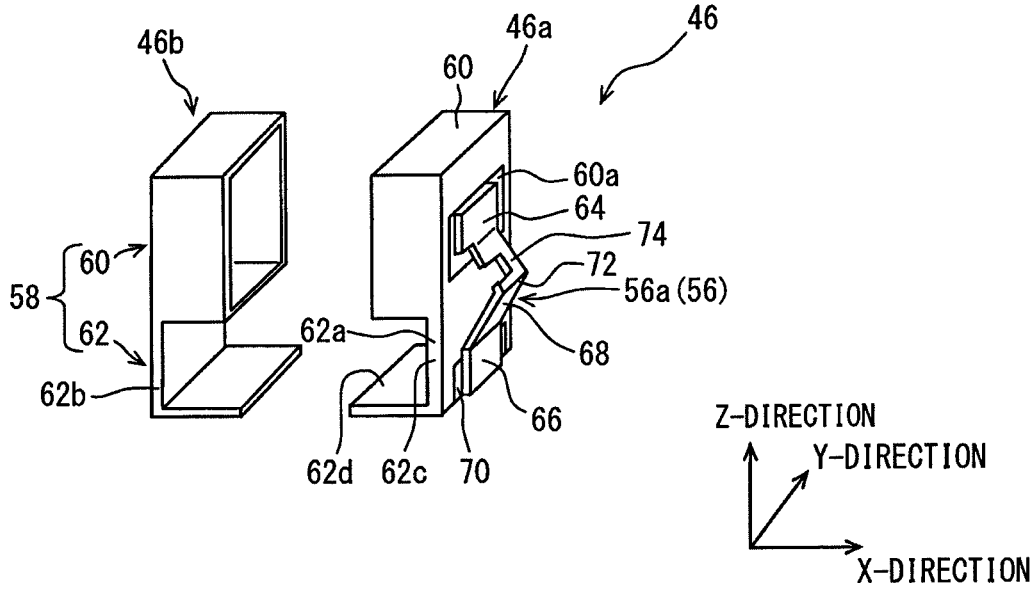
FIG. 4 is a schematic perspective view showing terminals.

The circuit board 12, in particular, the electronic part 28*a*, will be explained more in detail with reference to FIGS. 3 to 5. FIGS. 3 and 4 show relevant portions of the circuit board 12, including the electronic part 28*a* and portions of the circuit board 12 neighboring to the electronic part 28*a* mounted to the printed board 26.

In the present application, a direction, which is in parallel to the board surface 26*a* of the printed board 26 and in which electrodes 48 and 50 are arranged, is referred to as an X-direction. A direction parallel to the board surface 26*a* and perpendicular to the X-direction is referred to as a Y-direction. A direction perpendicular to the board surface 26*a*, that is a thickness direction of the printed board 26 is referred to as a Z-direction.

The printed board 26 is composed of an insulating board 38 made of resin or ceramics as its main material, and wiring patterns 40 made of conducting material (such as copper) and arranged on the insulating board 38. Although not shown in the drawing, in the present embodiment, the wiring patterns 40 are formed in a multi-layer structure on the insulating board 38 and the wiring patterns 40 are formed at both board surfaces of the insulating board 38.

A resist (not shown) is arranged on a board surface of the insulating board 38 (corresponding to the front-side board surface 26*a* of the printed board 26) so as to cover the wiring patterns 40. The resist has openings (not shown) at predetermined positions. A portion of the wiring patterns 40, which is exposed to an outside of the printed board 26 via the opening of the resist, forms a land 40*a* connected to the electronic part 28 via solder 42. The lands 40*a* are also arranged in the X-direction as in the same manner to the electrodes 48 and 50.

Each of the electronic parts 28*a* has an electronic-element main body 44 and multiple terminals 46.

The electronic-element main body 44 (hereinafter, the main body 44) has at least one electronic element (a capacitor as explained below) and multiple electrodes 48 and 50 electrically connected to the electronic element and arranged at outer surfaces of the main body 44. The main body 44 is arranged above the front-side board surface 26*a* of the printed board 26. In other words, the main body 44 is held at a position which is separated from the board surface (from the front-side board surface in the present embodiment).

Figure 5:
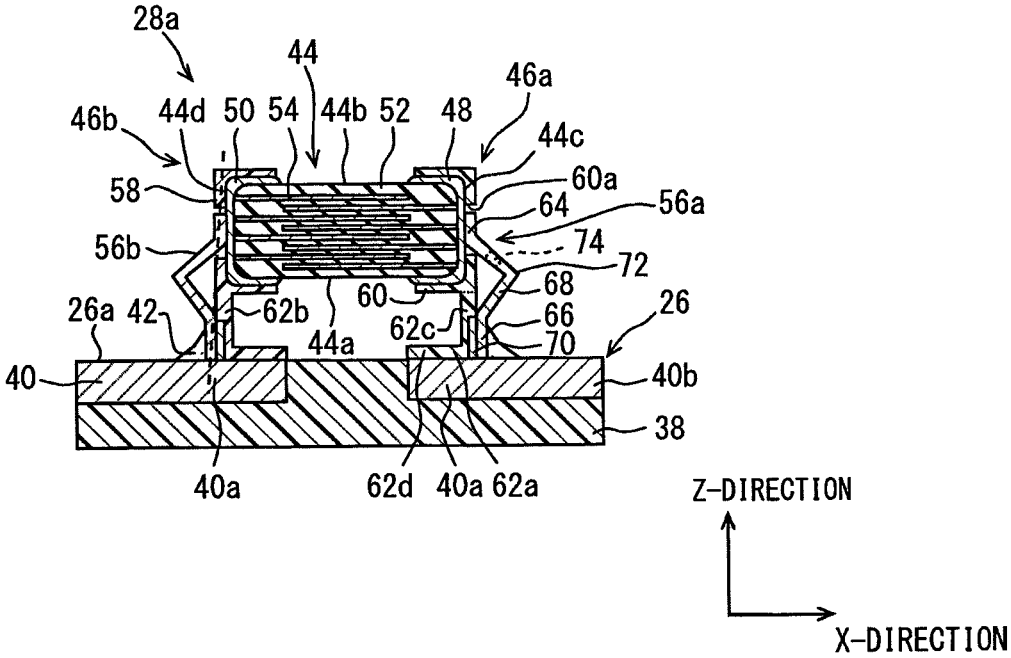
FIG. 5 is a schematic cross sectional view taken along a line V-V in FIG. 3.
Figure 6:
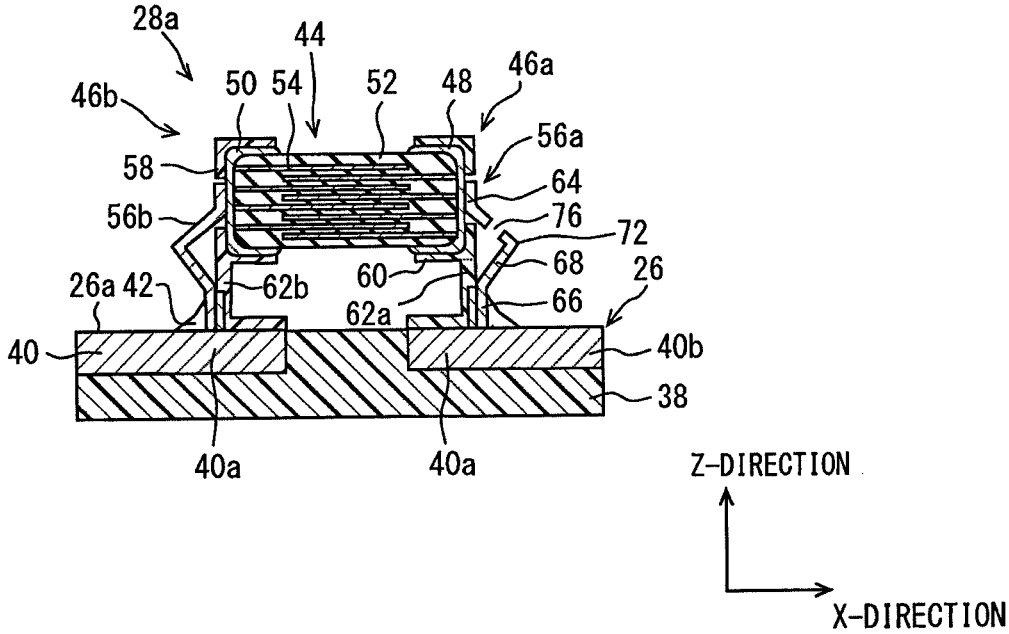
FIG. 6 is a schematic cross sectional view in which a cut-off portion of FIG. 5 is melted down.

In the present embodiment, the circuit board 12 has multiple electronic parts 28*a*, one of which is composed of a ceramic-type laminated capacitor shown in FIG. 5. As shown in FIG. 5, the main body 44 of the electronic part 28*a* (the ceramic-type laminated capacitor) has dielectric layers 52 made of high-dielectric ceramics of a barium-titanate type and electric conductor layers 54, wherein the dielectric layers 52 and the electric conductor layers 54 are alternately laminated. The electrodes 48 and 50 are connected to the electric conductor layers 54.

As shown in FIG. 3, an outer shape of the main body 44 of the electronic part 28*a* is formed in a rectangular shape on a plane, which is defined by the X-direction and the Y-direction, that is, a plane which is in parallel to the front-side board surface 26*a* of the printed board 26. A longitudinal direction of the rectangular shape corresponds to the X-direction. The main body 44 has the electrodes 48 and 50 at its both longitudinal ends in the X-direction.

A reference numeral 44*a* designates a lower-side surface of the main body 44 facing to the front-side board surface 26*a*. A reference numeral 44*b* designates an upper-side surface, which is on an opposite side to the lower-side surface 44*a* in the Z-direction. A reference numeral 44*c* designates a first side surface of the main body 44 in the X-direction. A reference numeral 44*d* designates a second side surface, which is on an opposite side to the first side surface 44*c* in the X-direction. Although not designated by reference numerals, one of side surfaces of the main body 44 in the Y-direction and between the first and second side surfaces 44*c* and 44*d* is referred to a third side surface, while the other of the side surfaces opposite to the third side surface is referred to a fourth side surface.

The electrode 48 (also referred to as a first electrode) is formed at one of the longitudinal ends of the main body 44 including the first side surface 44*c*. More exactly, the electrode 48 is formed on the first side surface 44*c*, a part of the lower-side surface 44*a*, a part of the upper-side surface, a part of the third side surface and a part of the fourth side surface. The electrode 50 (also referred to as a second electrode) is formed at the other of the longitudinal ends of the main body 44 including the second side surface 44*d*. More exactly, the electrode 50 is formed on the second side surface 44*d*, another part of the lower-side surface 44*a*, another part of the upper-side surface 44*b*, another part of the third side surface and another part of the fourth side surface.

Each of the terminals 46 has a first function (a supporting function) for supporting the main body 44 at a position above and separated from the board surface 26*a* and a second function (a wiring function) for electrically connecting each of the electrodes 48 and 50 to the respective lands 40*a*. Each of the terminals 46 is connected to the respective electrodes 48 and 50 and has a wiring member 56 soldered to the land 40*a* in a condition that the main body 44 is supported at the position above the board surface 26*a*. Each of the terminals 46 has a supporting member 58 made of electrically insulating material. The supporting member 58 is in contact with (connected to) the main body 44 and the board surface 26*a* so as to support the main body 44 at the position above the board surface 26*a*. As above, the terminal 46 is not made of one element having both of the supporting function and the wiring function, but the terminal 46 is composed of the supporting member 58 having the supporting function and the wiring member 56 having the wiring function.

In the present embodiment, the terminals 46 are composed of the fuse terminal 46*a* connected to the first electrode 48 and a normal terminal 46*b* connected to the second electrode 50.

Each of the supporting members 58 has a holding portion 60, which is in contact with the main body 44 for holding it at the position above the board surface 26*a*. At least, a contacting portion of the holding portion 60 is made of the electrically insulating material. Each of the supporting members 58 has a leg portion 62 extending from the holding portion 60 in the Z-direction toward the board surface 26*a*. The leg portion 62 is deformable in the X-direction.

Each of the supporting members 58, except for a fixing portion 70 (explained below), is made of resin material. Each of the fuse terminal 46*a* and the normal terminal 46*b* has the supporting member 58. Each of the holding portions 60 is formed in a box shape having an open end at its one side surface so as to hold each of the electrodes 48 and 50. The holding portion 60 of the box shape has five inner walls, each of which faces to the respective outer surfaces of the main body 44 on which the electrode 48 or 50 is formed. A depth of the box-shaped holding portion 60 is almost equal to a length of the electrode 48 or 50 in the X-direction. Each of the electrodes 48 and 50 is press-inserted into the box-shaped holding portion 60. Each of the electrodes 48 and 50 may be fixed to the holding portion 60 not by the press-insertion but by any other methods, such as adhesion, clipping, fitting and so on.

The holding portion 60 of the fuse terminal 46*a* has an opening 60*a* in a wall of the holding portion 60 facing to the first side surface 44*c* of the main body 44, so that the electrode 48 is exposed to the outside through the opening 60*a*. In the same manner, the holding portion 60 of the normal terminal 46*b* has an opening 60*a* (not shown) in a wall of the holding portion 60 facing to the second side surface 44*d*, so that the electrode 50 is exposed to the outside through the opening 60*a*.

The leg portion 62 of the fuse terminal 46*a*, which extends from the holding portion 60 toward the printed board 26, is referred to as a first leg portion 62*a*. The leg portion 62 of the normal terminal 46*b*, which extends from the holding portion 60 toward the printed board 26, is referred to as a second leg portion 62*b*. Each of the leg portions 62 (62*a*, 62*b*) extends from the holding portion 60 on a side of the lower-side surface 44*a* of the main body 44 in the Z-direction toward the printed board 26. Each of the leg portions 62 (62*a*, 62*b*) has a vertical wall portion 62*c* extending from the holding portion 60 in the Z-direction and a seat portion 62*d* bent at a lower end of the vertical wall portion 62*c* and extending in the X-direction toward the leg portion 62 of the opposite terminal 46. The seat portion 62*d* is arranged on the board surface 26*a* and located at the corresponding land 40*a*. Each of the leg portions 62 (62*a*, 62*b*) has a width in the Y-direction (a direction perpendicular to a wall extending direction), wherein the width is constant for its entire length. A thickness of each leg portion 62 (62*a*, 62*b*) is also constant for its entire length. The vertical wall portion 62*c* is elastically deformable in the X-direction.

The wiring member 56 of each terminal 46 (46*a*, 46*b*) has an electrode-connected portion 64 electrically and mechanically connected to each of the electrodes 48 and 50. The wiring member 56 has a land-connected portion 66 fixed to the leg portion 62 (the vertical wall portion 62*c*) and soldered to the land 40*a*. Furthermore, each of the wiring members 56 has a connecting portion 68 for connecting the electrode-connected portion 64 and the land-connected portion 66 with each other. In the present embodiment, the wiring member 56 of the fuse terminal 46*a* connected to the electrode 48 is referred to as a fuse wiring member 56*a*, while the wiring member 56 of the normal terminal 46*b* connected to the electrode 50 is referred to as a normal wiring member 56*b*. Each of the wiring members 56 (56*a*, 56*b*) is made of a metal plate having a constant thickness by punching out in a predetermined shape and bending it in a predetermined three-dimensional shape.

The electrode-connected portion 64 of each wiring member 56 is arranged in the opening 60*a* of the holding portion 60 and connected by solder (not shown) to the respective electrode 48 or 50, each of which is exposed to the outside of the holding portion 60 via the opening 60*a*. More exactly, the electrode-connected portion 64 of the fuse wiring member 56*a* is connected to the electrode 48 formed on the first side surface 44*c* of the main body 44, while the electrode-connected portion 64 of the normal wiring member 56*b* is connected to the electrode 50 formed on the second side surface 44*d* of the main body 44.

The land-connected portion 66 is fixed to the vertical wall portion 62*c* of the leg portion 62. In the present embodiment, the leg portion 62 has the fixing portion 70 made of metal on a side opposite to the other terminal 46 in the X-direction, wherein the fixing portion 70 extends from the lower end of the vertical wall portion 62*c* in the Z-direction and has a predetermined height. The fixing portion 70 is made of, for example, a metal foil attached to a surface of the vertical wall portion 62*c* made of resin. Alternatively, the fixing portion 70 is made by an insert-molding process so that the fixing portion 70 is integrally molded in the vertical wall portion 62*c* made of the resin. The land-connected portion 66 is connected to the fixing portion 70 of the leg portion 62 by solder (not shown). The land-connected portion 66 is further connected to the land 40*a* by the solder 42, as shown in FIG. 5.

The connecting portion 68 of each wiring member 56 extends in the Z-direction so as to connect the electrode-connected portion 64 and the land-connected portion 66 with each other. The connecting portion 68 is convexed in a direction opposite to the other terminal 46 in the X-direction. The connecting portion 68, which has a bent portion 72, is formed in a V-letter shape in a cross section on a plane defined by the X-direction and the Z-direction. The wiring member 56 is also bent at an upper-side boundary between the electrode-connected portion 64 and the V-shaped connecting portion 68 and a lower-side boundary between the land-connected portion 66 and the V-shaped connecting portion 68.

A cut-off portion 74 is formed in the fuse wiring member 56*a* of the fuse terminal 46*a*. The cut-off portion 74 is formed as a part of the connecting portion 68. The cut-off portion 74 is held at a position above and separated from the board surface 26*a* of the printed board 26, in a condition that the fuse terminal 46*a* is soldered to the land 40*a*.

A width of the cut-off portion 74 is made smaller than that of the other portions of the connecting portion 68 of the fuse wiring member 56*a*, so that the cut-off portion 74 is melted down depending on heat due to excess current in order to cut off the excess current. The width is a dimension in the Y-direction, which corresponds to a direction perpendicular to both of a direction of current flow in the fuse wiring member 56*a* and a thickness direction of the connecting portion 68 of the fuse wiring member 56*a*. In the present embodiment, since the fuse wiring member 56*a* is made of the metal plate having the constant thickness by punching out the metal plate to the predetermined shape and bending it to the three-dimensional shape, a cross sectional area (on the plane perpendicular to the current flow) of the cut-off portion 74 is made smaller than that of the other portions of the fuse wiring member 56*a*. The cut-off portion 74 is formed in the fuse wiring member 56*a* at a position closer to the electrode-connected portion 64 than the bent portion 72. In other words, the cut-off portion 74 is formed at a position above the bent portion 72.

The normal wiring member 56*b* has the same structure to that of the fuse wiring member 56*a*, except for the cut-off portion 74. Namely, the normal wiring member 56*b* has no cut-off portion.

As shown in FIG. 3, the fuse terminal 46*a* of the electronic part 28*a* is electrically connected to a power-source wiring pattern 40*b* via the land 40*a* and a connecting wiring pattern 40*c*. The power-source wiring pattern 40*b* corresponds to a part of the wiring patterns 40, which is commonly used for multiple electronic parts 28 (including the electronic part 28*a*). The power-source wiring pattern 40*b* is electrically connected to the battery 36 via the pin 30*a* of the connector 30.

A method of manufacturing the electronic part 28*a* and a method of mounting the electronic part 28*a* to the printed board 26 will be explained.

At first, the following parts are prepared;

the main body 44 having the electrodes 48 and 50;

a pair of the supporting members 58; and a pair of the wiring members 56 (56*a*, 56*b*), each having the predetermined shape with or without the cut-off portion 74.

Then, the supporting members 58 are attached to the main body 44. More exactly, the electrode 48 is press-inserted into the holding portion 60 of the supporting member 58 for the fuse terminal 46*a*. In the same manner, the electrode 50 is press-inserted into the holding portion 60 of the supporting member 58 for the normal terminal 46*b*.

The electrode-connected portion 64 of the fuse wiring member 56*a* is soldered to the electrode 48, which is exposed to the outside through the opening 60*a* of the holding portion 60. Then, the land-connected portion 66 is soldered to the fixing portion 70 of the first leg portion 62*a*. In the same manner to the above method, the electrode-connected portion 64 of the normal wiring member 56*b* is soldered to the electrode 50, which is exposed to the outside through the opening 60*a* of the holding portion 60. Then, the land-connected portion 66 is soldered to the fixing portion 70 of the second leg portion 62*b*. The electronic part 28*a* is thus completed.

The electronic part 28*a* is positioned on the board surface 26*a* of the printed board 26, so that each of the seat portions 62*d* of the leg portions 62 is located on a corresponding land 40*a*. Then, the land-connected portion 66 and the land 40*a* are electrically and mechanically connected to each other by the solder 42. As above, the electronic control unit 10 having the electric circuits is completed.

Advantages of the electronic part 28*a* and the electronic control unit 10 of the present embodiment will be explained.

In the present embodiment, the electrodes 48 and 50 of the electronic part 28*a* are not directly connected to the lands 40*a* via the solders 42. Instead, the multiple terminals 46 (more exactly, the wiring members 56) are provided between the electrodes 48 and 50 and the lands 40*a* so that each of the electrodes 48 and 50 is indirectly connected to the lands 40*a* via the wiring members 56. In addition, one of the wiring members 56 for the terminals 46 is composed of the fuse wiring member 56*a* having the cut-off portion 74. Accordingly, when short-circuit occurs in the electronic part 28*a* and thereby the excess current (short-circuit current) flows, the heat is generated at the cut-off portion 74 having the smaller width depending on the excess current. And when temperature at the cut-off portion 74 becomes higher than a predetermined value, the cut-off portion 74 is melted down and the electrical connection between the electrode 48 and the land 40*a* is cut off. As a result, a gap 76 is formed at a position, where the cut-off portion 74 existed before its melt-down. Accordingly, it is possible to quickly cut off the electrical connection between the electrode 48 and the land 40*a* when the excess current flows through the cut-off portion 74 of the fuse terminal 46*a*.

As above, the function for cutting off the excess current (the short-circuit current) caused by the short-circuit fault of the electronic part 28*a* is realized not by a pattern fuse formed in the printed board 26 but by the fuse terminal 46*a* for the electronic part 28*a*. As a result, it becomes possible to commonalize and/or standardize the printed boards 26, which can be commonly used for the different types of the electronic control units. Therefore, it is possible to provide variation products, for which the same printed boards 26 can be used but different electronic parts 28*a* are mounted to the printed board.

In addition, it is possible to make the size of the printed board 26 as well as the electronic control unit 10 smaller by such a volume corresponding to the pattern fuse, which is not necessary in the present embodiment.

In the fuse wiring member 56*a*, the cut-off portion 74 is formed as a part of the connecting portion 68, which connects the electrode-connected portion 64 to the land-connected portion 66. Therefore, the cut-off portion 74 is not in contact with the board surface 26*a* of the printed board 26 but located at the position above and separated from the board surface 26*a*. It is, therefore, possible to avoid a situation that melted-down metal spreads over the board surface 26*a* and melted-down portions of the cut-off portion 74 are connected again.

In particular, according to the present embodiment, the wiring function for electrically connecting the electrodes 48 and 50 to the lands 40*a* and the supporting function for supporting the main body 44 are separately provided by the wiring members 56 and the supporting members 58. In other words, the main body 44 is supported by the supporting members 58 at the position above the board surface 26*a*, independently whether the cut-off portion 74 is melted down or not. Accordingly, it is possible to support the main body 44 by the supporting members 58 even when the cut-off portion 74 of the fuse wiring member 56*a* is melted down. It is, therefore, possible to more effectively prevent the re-connection of the fuse wiring member 56*a*.

Figure 7:
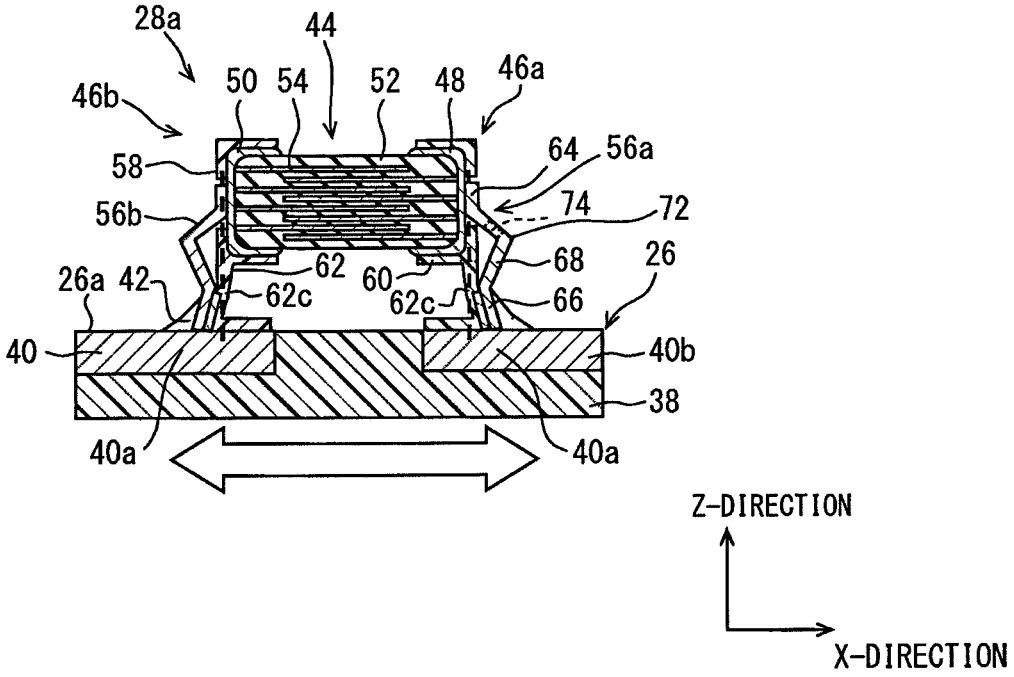
FIG. 7 is a schematic cross sectional view for explaining an effect of the first embodiment for reducing stress.

In addition, the leg portion 62 of the supporting member 58, in particular, the vertical wall portion 62*c* is elastically deformable in the X-direction, in which the electrodes 48 and 50 are arranged. When a difference of expansion and contraction (a relative displacement) is generated between the printed board 26 and the main body 44 by a difference of linear coefficient of expansion, the leg portion 62 is elastically deformed. FIG. 7 shows a condition in which the printed board 26 is expanded in the X-direction relative to the main body 44 as a result of increase of ambient temperature. As shown in FIG. 7, the vertical wall portion 62*c* of the leg portion 62 is elastically deformed. In FIG. 7, dotted lines show the positions of the respective vertical wall portions 62*c* before the elastic deformation. As above, by the leg portions 62 of the supporting members 58, it is possible to reduce stress applied to connected areas between the wiring members 56 and the electrodes 48 and 50 and stress applied to connected areas between the wiring members 56 and the lands 40*a*. Accordingly, it is possible to increase reliability of electrical and mechanical connection at those connected areas.

In each of the wiring members 56, the connecting portion 68 is outwardly expanded from a virtual line connecting the electrode-connected portion 64 and the land-connected portion 66 with each other. In other words, the connecting portion 68 is outwardly convexed in the direction opposite to the main body 44. According to the above structure, it is possible that the connecting portion 68 is also elastically deformed depending on the leg portion 62, when the printed board 26 is expanded and the leg portion 62 is correspondingly deformed. Since the connecting portion 68 has a flexible structure for absorbing the elastic deformation of the leg portion 62 as above, it is possible to further increase reliability for the mechanical and electrical connection between the electrodes 48 and 50 and the lands 40*a*.

The connecting portion 68 has the V-shaped bent portion 72. It is easy to manufacture the wiring member 56 having the connecting portion 68 of such a shape and it is easy to control the shape of the wiring member 56.

The cut-off portion 74 is supported at the position above and separated from the board surface 26*a* of the printed board 26, in the condition that the fuse terminal 46*a* is connected to the land 40*a*. Therefore, the heat of the cut-off portion 74 does not directly go away to the printed board 26. It is, thereby, possible to shorten a time period between the short-circuit failure of the electronic element formed in the main body 44 and the melt-down of the cut-off portion 74. In other words, the response for the short-circuit failure is improved. In addition, since it is possible to reduce variation of the response performances, accuracy for cutting-off performances can be improved.

In a case that the response is improved by the pattern fuse, it is necessary to make the pattern fuse thinner than other portions of the wiring patterns or to make the pattern fuse with such material which is more easily melted down than the other portions of the wiring patterns. However, the above method increases manufacturing cost.

According to the present embodiment, since the heat of the cut-off portion 74 is not easily transferred to the printed board 26, it is possible not only to improve the response but also to reduce the manufacturing cost. Furthermore, since the heat of the cut-off portion 74 is not easily transferred to the printed board 26, it is possible to loosen up designing of heat-resisting performance for the printed board 26. The manufacturing cost is correspondingly further reduced.

In the printed board having the pattern fuses, heat generated at electronic parts neighboring to one pattern fuse and/or heat generated at other pattern fuses adjacent to the one pattern fuse is transferred to the one pattern fuse via the insulating board and the wiring patterns. Since the pattern fuse is influenced by the heat generated at portions surrounding the pattern fuse, the pattern fuse may be melted down before the short-circuit fault occurs in the electronic part, in a case of a high-density packaging.

According to the present embodiment, however, since the cut-off portion 74 is held at the position above and separated from the board surface of the printed board 26, the cut-off portion 74 is not easily influenced by the heat of the other electronic parts 28. It is, therefore, possible to realize the high-density packaging. In other words, the size of the printed board 26 can be reduced and thereby the manufacturing cost can be correspondingly reduced.

In the electronic control unit 10, at least some of the multiple electronic parts 28*a* having the fuse terminals 46*a* are connected to the power-source wiring pattern 40*b* via the lands 40*a* and the connecting wiring patterns 40*c*. As already explained above, when the short-circuit fault occurs in one of the electronic parts 28*a* and the excess current flows in the fuse terminal 46*a*, the connection between the electrode 48 and the land 40*a* is immediately cut off by the melt-down of the cut-off portion 74 of the fuse terminal 46*a* (which has connected the electrode 48 and the land 40*a* before the melt-down). Accordingly, it is possible to protect the other electronic parts 28 connected to the power-source wiring pattern 40*b* from the excess current.

The excess current flowing in the fuse terminal 46*a* for cutting off the cut-off portion 74 is not so large as the excess current for cutting off the main fuse 34. Therefore, it is possible to suppress adverse influence, which may be caused by the excess current flowing in the fuse terminal 46*a*, to power-supply to the other electronic devices.

In the present embodiment, the electronic part 28*a* includes the ceramic-type laminated capacitor. In a case that the electronic part 28*a* of the laminated structure is used, the size of the electronic part 28*a* can be made smaller and the high-density packaging for the printed board 26 can be realized. However, on the other hand, the electronic part having the laminated structure may have a problem that the electric conductor layers 54 (which are laminated in multiple layers) are likely to be short-circuited by vehicle vibration and/or heat stress. In the present embodiment having the electronic part 28*a* of the laminated structure, however, it is possible to rapidly cut off the electrical connection between the electrode 48 and the land 40*a*, if the short-circuit fault occurs.

The battery of a lithium system is more advantageous than a lead battery in view of power supplying capability. On the other hand, the lithium battery has such a disadvantage that it will be quickly deteriorated when current larger than a rated output current is supplied to electric loads. According to the present embodiment, however, the electrical connection between the electrode 48 and the land 40*a* is immediately cut off by the fuse terminal 46*a* in the case of short-circuit in the electronic part 28*a*. It is, therefore, possible to suppress adverse influence to the battery to a minimum value.

In the present embodiment, the connecting portion 68 of the wiring member 56 is formed in the V-letter shape. However, the shape of the connecting portion 68 should not be limited to the V-letter shape. Any other shapes can be applied to the connecting portion 68. For example, as shown in FIGS. 8A and 8B, an intermediate portion of the connecting portion 68 is expanded in the direction opposite to the main body 44 (in other words, the intermediate portion of the connecting portion 68 is outwardly convexed in the X-direction) from the virtual line connecting the electrode-connected portion 64 and the land-connected portion 66 with each other.

Figure 8A:
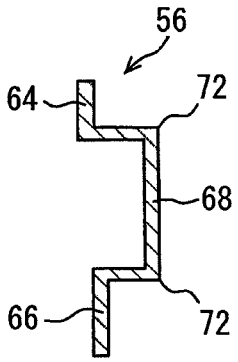
FIGS. 8A and 8B are schematic views, each of which shows a modification of a wiring member.
Figure 8B:
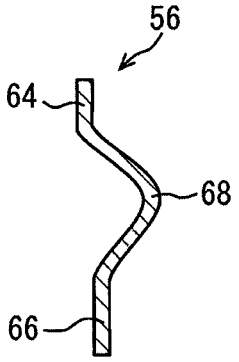

In FIG. 8A, the connecting portion 68 is formed in a U-letter shape having two bent portions 72. In FIG. 8B, the connecting portion 68 is formed in a C-letter shape or an arc shape having no bent portion.

In the present embodiment, the leg portion 62 has the vertical wall portion 62*c* and the seat portion 62*d*. It is not always necessary to provide the seat portion 62*d*. Namely, the supporting member 58 may have only the leg portion 62 extending from the holding portion 60 toward the printed board 26 and a forward end of the leg portion 62 is in contact with the board surface 26*a* of the printed board 26.

Second Embodiment

A second embodiment of the present disclosure will be explained with reference to FIGS. 9 and 10. Explanation for those portions, which are similar to or the same to those of the first embodiment (including the electronic part 28*a*, the electronic control unit 10 and so on), will be omitted.

Figure 9:
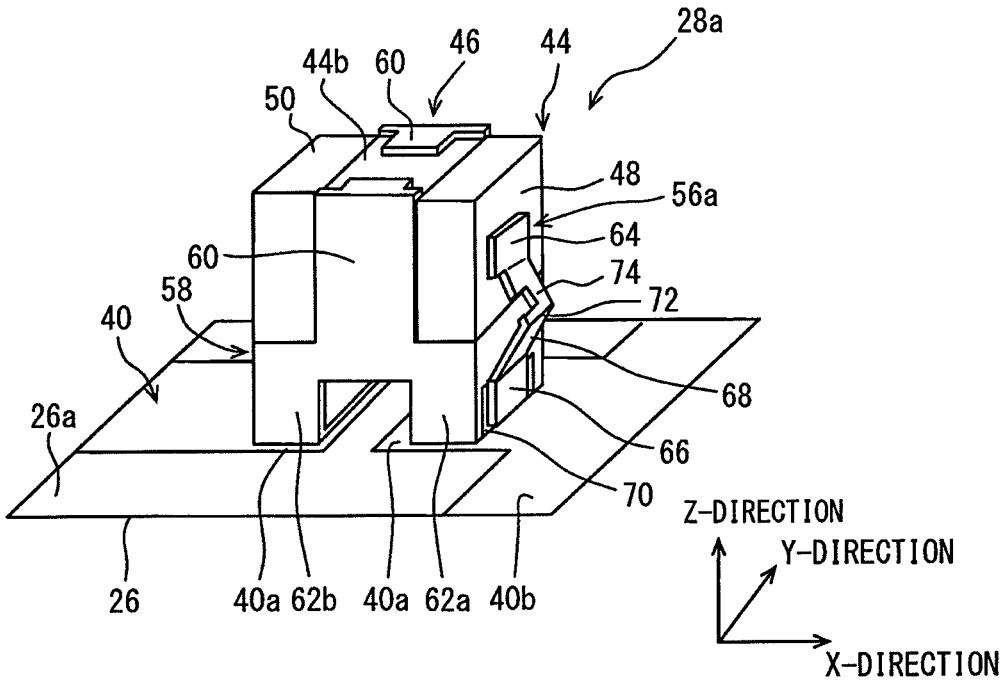
FIG. 9 is a schematically enlarged perspective view showing a portion of a printed board according to a second embodiment, wherein FIG. 9 corresponds to FIG. 3.
Figure 10:
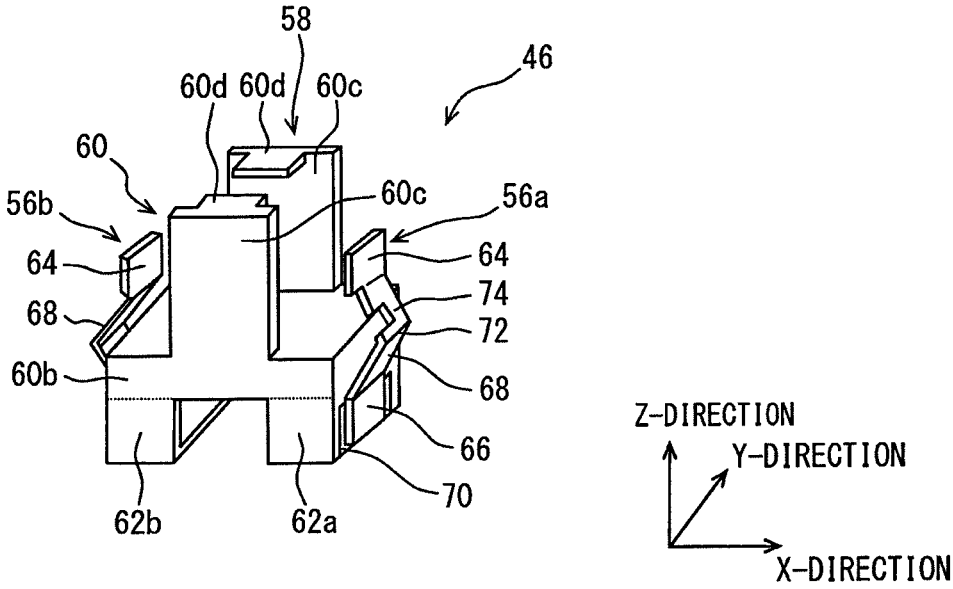
FIG. 10 is a perspective view schematically showing a structure of a terminal unit, wherein FIG. 10 corresponds to FIG. 4.

As shown in FIGS. 9 and 10, each of the leg portions 62 (the first leg portion 62*a* and the second leg portion 62*b*) extends from a common holding portion 60 toward the printed board 26. The fuse wiring member 56*a* and the normal wiring member 56*b* are provided in a common terminal unit 46.

In the present embodiment, the supporting member 58 is made of the resin material, except for the fixing portion 70. The holding portion 60 is composed of a base portion 60*b* which is in contact with the lower-side surface 44*a* of the main body 44, a pair of wall portions 60*c* each of which extends from the base portion 60*b* in the Z-direction opposite to the printed board 26, and a pair of claw portions 60*d* which is brought into contact with the upper-side surface 44*b* of the main body 44.

The base portion 60*b* is formed in a flat plate shape having a rectangular surface corresponding to the lower-side surface 44*a* of the main body 44, wherein the rectangular surface is in parallel to a plane defined by the X-direction and the Y-direction.

The holding portion 60 has the pair of wall portions 60*c*, which are opposing to each other in the Y-direction so that each of the wall portions 60*c* faces to and is respectively in contact with the third and fourth side surfaces of the main body 44. The main body 44 is held between the pair of the wall portions 60*c* in the Y-direction.

One of the claw portions 60*d* extends from a forward end (an upper end) of the wall portion 60*c* (on an opposite side to the base portion 60*b*) in the Y-direction to the claw portion 60*d* of the other side. A space is formed between the pair of the claw portions 60*d* in the Y-direction. The main body is held between the base portion 60*b* and the claw portions 60*d* in the Z-direction.

The leg portion 62 has the first leg portion 62*a* and the second leg portion 62*b*. The first leg portion 62*a* extends in the Z-direction from a longitudinal end of the base portion 60*b*, which (the longitudinal end) is closer to the electrode 48, toward the printed board 26. The second leg portion 62*b* likewise extends in the Z-direction from another longitudinal end of the base portion 60*b*, which (the other longitudinal end) is closer to the electrode 50, toward the printed board 26.

Each of the first and second leg portions 62*a* and 62*b* has a structure corresponding to the vertical wall portion 62*c* of the leg portion 62 of the first embodiment. A thickness of the leg portion 62 (62*a*, 62*b*) in the X-direction is made smaller so that the leg portion is elastically deformed. Each of the leg portions 62 has a cross section of a U-letter shape on a plane defined by the X-direction and the Y-direction.

When the electronic part 28*a* is manufactured, the following parts are prepared at first, as in the same manner to the first embodiment;

the main body 44 having the electrodes 48 and 50;

the supporting member 58; and the wiring members 56 (the fuse wiring member 56*a* and the normal wiring member 56*b*).

The supporting member 58 is attached to the main body 44. More exactly, each of the wall portions 60*c* and the claw portions 60*d* is outwardly and elastically bent by a bending force so that the claw portions 60*d* are separated from each other in the Y-direction. Then, the main body 44 is arranged between the wall portions 60*c* and between the base portion 60*b* and the claw portions 60*d*. The bending force is released from the wall portions 60*c* and the claw portions 60*d*, so that the claw portions 60*d* are brought into contact with the upper-side surface 44*b* of the main body 44.

The electrode-connected portion 64 of the fuse wiring member 56*a* is soldered to the electrode 48 formed on the first side surface 44*c* of the main body 44, while the land-connected portion 66 is soldered to the fixing portion 70 of the first leg portion 62*a*. In a similar manner, the electrode-connected portion 64 of the normal wiring member 56*b* is soldered to the electrode 50 formed on the second side surface 44*d* of the main body 44, while the land-connected portion 66 is soldered to the fixing portion 70 of the second leg portion 62*b*. The electronic part 28*a* is thus completed.

The same advantages to those of the first embodiment can be obtained in the electronic part 28*a* of the second embodiment.

In the present embodiment, since the multiple wiring members 56 (56*a*, 56*b*) are connected to one common supporting member 58, a number of assembling processes for the electronic part 28*a* can be reduced.

The present disclosure should not be limited to the above embodiments but can be modified in various manners without departing from the spirits of the present disclosure.

In the above embodiments, one of the wiring members 56 is composed of the fuse wiring member 56*a* having the cut-off portion 74. However, the number of the fuse wiring member should not be limited to one for one electronic part 28*a*. For example, all of the wiring members may be composed of the fuse wiring members 56*a*.

In such a case, even when not only the cut-off portion 74 connected to the electrode 48 but also the cut-off portion 74 connected to the electrode 50 is melted down, the main body 44 can be held at the position above the board surface by the supporting member(s) 58. Accordingly, it is possible to prevent the re-connection of the fuse wiring member 56*a*.

In the above embodiments, one wiring member 56 is connected to each of the electrodes 48 and 50. However, a number of the wiring member to be connected to one electrode 48 or 50 should not be limited to one. For example, multiple fuse wiring members 56*a* may be connected to the electrode 48. Alternatively, multiple normal wiring members 56*b* may be connected to the electrode 50.

In the above embodiments, the ceramic-type laminated capacitor is explained as the example for the electronic part 28*a*. However, the above structures may be applied to any other types of the electronic elements. For example, a laminated inductor may be used as the electronic element having the laminated structure.

Furthermore, the above structure should not be limited to the electronic elements having the laminated structure but can be applied to any other types of the electronic elements, for example, such an electronic element having more than two electrodes, such as a multiple-chip resistor.

A number of the leg portions 62 should not be equal to that of the electrodes 48 and 50. For example, in the first embodiment, the fuse terminal 46*a* may have two first leg portions 62*a*, each of which extends from the holding portion 60. And at least one of the first leg portions 62*a* is formed with the fixing portion 70*c* (the land-connected portion 66) to be connected to the land 40*a*.

In the above embodiments, the supporting member 58 has the fixing portion 70. However, it is not always necessary that the fixing portion 70 is provided in the supporting member 58. In a case of the supporting member having no fixing portion 70, the land-connected portion 66 of the wiring member 56 may be connected to the leg portion 62 made of the resin material by adhesive material.

In addition, in the above embodiments, the supporting member 58 is made of the resin material, except for the fixing portion 70. The material for the supporting member 58 should not be limited to the resin material. For example, the supporting member 58 may be made of electrically insulating material other than the resin material. More exactly, a contacting portion of the supporting member 58, which is in contact with the main body 44, may be made of the electrically insulating material. And the leg portion 62 may be made of such material for allowing the elastic deformation of the leg portion 62 in the direction, in which the electrodes 48 and 50 are arranged. As above, the supporting member 58 may be made of the electrically insulating material other than the resin material and the supporting member 58 may include a portion made of metal material, such as the fixing portion 70. However, when the supporting member 58 is made of the resin material like the above embodiments, it becomes easier to have the supporting function for supporting the main body 44 and it becomes easier to make the leg portion 62 which is flexible and elastically deformable.

In the above embodiments, the electronic part 28*a* having the fuse terminal 46*a* is electrically connected to the power-source wiring pattern 40*b* (connected to the battery 36) via the land 40*a* and the connecting wiring pattern 40*c*. However, the electronic part 28*a* having the fuse terminal 46*a* may be electrically connected to other wiring patterns than the power-source wiring pattern.

What is claimed is:

1. An electronic part mounted to a printed board comprising:

a main body arranged at a position above and separated from a board surface of the printed board, the main body having at least one electronic element and multiple electrodes for the electronic element; and a terminal for supporting the main body at the position above and separated from the board surface of the printed board, the terminal electrically connecting each of the electrodes to respective lands formed in the printed board, wherein the terminal comprises:

a supporting member made of electrically insulating material and having one end in contact with the main body and another end in contact with the board surface of the printed board in order to support the main body at the position above and separated from the board surface; and a wiring member having an electrode-connected portion connected to one of the corresponding electrodes of the main body and a land-connected portion soldered to the land in a condition that the main body is supported at the position above and separated from the board surface, wherein the supporting member comprises:

a holding portion made of the electrically insulating material and being in contact with the main body for holding the main body;

a leg portion extending from the holding portion to the printed board, the leg portion being elastically deformable in a direction in which the multiple electrodes are arranged, wherein the wiring member comprises:

the electrode-connected portion electrically and mechanically connected to the corresponding electrode of the main body;

the land-connected portion connected to the leg portion and soldered to the land; and a connecting portion for electrically connecting the electrode-connected portion to the land-connected portion, wherein the wiring member is composed of a fuse wiring member, and wherein the fuse wiring member has a cut-off portion, which is formed at least as a part of the connecting portion and which has a width smaller than that of other portions of the connecting portion, so that the cut-off portion is melted down depending heat generated by excess current in order to cut off the excess current.

2. The electronic part according to claim 1, wherein the connecting portion is outwardly expanded in a direction opposite to the main body from a virtual line connecting the electrode-connected portion and the land-connected portion with each other.

3. The electronic part according to claim 2, wherein the connecting portion has a bent portion at a top of a convexed shape, in which the bent portion is outwardly expanded.

4. The electronic part according to claim 1, wherein the main body is formed in a rectangular shape on a plane in parallel to the surface board of the printed board, the multiple electrodes are composed of a first electrode formed at a first side surface of the main body and a second electrode formed at a second side surface of the main body, wherein the second side surface is formed at an opposite side to the first side surface, the electronic part includes multiple wiring members, which are composed of a first wiring member connected to the first electrode and a second wiring member connected to the second electrode, the electronic part includes multiple leg portions, which are composed of a first leg portion to which the first wiring member is connected and a second leg portion to which the second wiring member is connected, and each of the first and the second leg portions is elastically deformable in a direction, in which the first and the second side surfaces are arranged.

5. The electronic part according to claim 1, wherein the terminal is composed of a terminal unit having a common supporting member, and the supporting member has multiple leg portions, each of which extends from the common supporting member toward the board surface of the printed board.

6. The electronic part according to claim 1, wherein the terminal is composed of a fuse terminal having the fuse wiring member and a normal terminal having a normal wiring member, and each of the fuse terminal and the normal terminal has the holding portion and the leg portion extending from the holding portion toward the board surface of the printed board.

7. An electronic control unit comprising:

the electronic part according to claim 1; and a printed board having a land connected to a terminal of the electronic part.

8. An electronic part mounted to a printed board comprising:

a main body arranged at a position above and separated from a board surface of the printed board, the main body having at least one electronic element and multiple electrodes for the electronic element; and at least two terminals for supporting the main body at the position above and separated from the board surface of the printed board, each of the terminals electrically connecting each of the electrodes to respective lands formed in the printed board, wherein each of the terminals comprises:

a supporting member made of electrically insulating material and having one end in contact with the main body and another end in contact with the board surface of the printed board in order to support the main body at the position above and separated from the board surface; and a wiring member having an electrode-connected portion connected to one of the corresponding electrodes of the main body and a land-connected portion soldered to the land in a condition that the main body is supported at the position above and separated from the board surface, wherein the supporting member comprises:

a holding portion made of the electrically insulating material and being in contact with the main body for holding the main body;

a leg portion extending from the holding portion to the printed board, the leg portion being elastically deformable in a direction in which the multiple electrodes are arranged, wherein the wiring member comprises:

the electrode-connected portion electrically and mechanically connected to the corresponding electrode of the main body;

the land-connected portion connected to the leg portion and soldered to the land; and a connecting portion for electrically connecting the electrode-connected portion to the land-connected portion, wherein one of the wiring members is composed of a fuse wiring member, and wherein the fuse wiring member has a cut-off portion, which is formed at least as a part of the connecting portion and which has a width smaller than that of other portions of the connecting portion, so that the cut-off portion is melted down depending heat generated by excess current in order to cut off the excess current.

9. An electronic part mounted to a printed board comprising:

a main body arranged at a position above and separated from a board surface of the printed board, the main body having at least one electronic element and multiple electrodes for the electronic element; and a terminal unit for supporting the main body at the position above and separated from the board surface of the printed board and electrically connecting each of the electrodes to respective lands formed in the printed board, wherein the terminal unit comprises:

a supporting member made of electrically insulating material and having one end in contact with the main body and another end in contact with the board surface of the printed board in order to support the main body at the position above and separated from the board surface; and a first and a second wiring members, each having an electrode-connected portion connected to one of the corresponding electrodes of the main body and a land-connected portion soldered to the land in a condition that the main body is supported at the position above and separated from the board surface, wherein the supporting member comprises:

a common holding portion made of the electrically insulating material and being in contact with the main body for holding the main body;

a first and a second leg portions, each extending from the common holding portion to the printed board, each of the leg portions being elastically deformable in a direction in which the multiple electrodes are arranged, wherein each of the first and the second wiring members comprises:

the electrode-connected portion electrically and mechanically connected to the corresponding electrode of the main body;

the land-connected portion connected to the corresponding leg portion and soldered to the land; and a connecting portion for electrically connecting the electrode-connected portion to the land-connected portion, wherein the first wiring member is composed of a fuse wiring member, and wherein the fuse wiring member has a cut-off portion, which is formed at least as a part of the connecting portion and which has a width smaller than that of other portions of the connecting portion, so that the cut-off portion is melted down depending heat generated by excess current in order to cut off the excess current.

* * * * *